US006745762B1

(12) United States Patent
Shiue

(10) Patent No.: US 6,745,762 B1
(45) Date of Patent: Jun. 8, 2004

(54) SNORKEL WITH LUMINOUS DEVICE

(75) Inventor: Chih-Cheng Shiue, Rancho Santa Fe, CA (US)

(73) Assignee: QDS Injection Molding LLC., Rancho Santa Fe, CA (US)

( * ) Notice: Subject to any disclaimer, the term of this patent is extended or adjusted under 35 U.S.C. 154(b) by 0 days.

(21) Appl. No.: 10/413,284

(22) Filed: Apr. 15, 2003

(51) Int. Cl.[7] ..... B63C 11/16

(52) U.S. Cl. ..... 128/201.11; 128/201.27; 128/205.23

(58) Field of Search ..... 128/201.11, 201.27, 128/201.28, 205.23; 114/315; 405/186; 441/6, 55, 89; 362/105, 158

(56) References Cited

U.S. PATENT DOCUMENTS 3,596,082 A * 7/1971 Doret et al. ..... 362/139
3,648,643 A * 3/1972 Murray ..... 114/382
3,698,338 A * 10/1972 Hymowitz ..... 114/15
4,021,661 A * 5/1977 Levine ..... 398/104
4,116,237 A * 9/1978 Birch ..... 128/201.11
4,195,922 A * 4/1980 Hajnal ..... 348/335
4,375,913 A * 3/1983 Hajnal ..... 396/432
4,580,886 A * 4/1986 Hajnal ..... 396/432
4,638,410 A * 1/1987 Barker ..... 362/105
4,868,588 A * 9/1989 Hajnal ..... 396/432
4,936,804 A * 6/1990 Dowdeswell ..... 441/6
5,024,178 A * 6/1991 Bruce ..... 114/315
5,074,295 A * 12/1991 Willis ..... 128/200.24
5,400,736 A * 3/1995 Gold ..... 116/26
5,469,236 A * 11/1995 Roessel ..... 396/432
5,553,606 A * 9/1996 Chen ..... 128/202.13
5,622,422 A * 4/1997 Rodgers ..... 362/158
5,701,740 A * 12/1997 Tveter ..... 60/505
5,701,884 A * 12/1997 Fondas et al. ..... 128/201.11
5,839,931 A * 11/1998 Shieh ..... 441/6
5,886,839 A * 3/1999 Arnone et al. ..... 359/857
6,122,100 A * 9/2000 Miller ..... 359/402

* cited by examiner

*Primary Examiner*—Aaron J. Lewis
(74) *Attorney, Agent, or Firm*—Troxell Law Office PLLC

(57) ABSTRACT

An illuminating device of a snorkel is located on the upper end of the snorkel. The illuminating device includes a sealed box-shaped housing wherein the circuits, batteries and LEDs . . . etc are located inside. Also, there is a switch assembled to the housing control the LED. By this way, the user of the snorkel can get attention from others.

10 Claims, 5 Drawing Sheets

SNORKEL WITH LUMINOUS DEVICE

FIELD OF THE INVENTION

The present invention relates generally to snorkels and, more particularly, device assembled on the upper end of the snorkel, wherein this device can illuminate as well as flash and easily get other people's attention.

BACKGROUND OF THE INVENTION

Normally when a diver is using a snorkel in a regular case, the top of the snorkel is always above the water surface. However, when a snorkel is misused, covered by wave, dived into water, or even when the diver is in danger situation, the top of the snorkel would be under water. Also, the top of the snorkel can be covered by water when the user submerges underwater during a dive. This situation can often happen to children, seniors or first timers, who are people that should be specially alerted and watched by others.

Often a splash protector is equipped on the top of a snorkel to prevent from water entering the snorkel. Some splash protectors even allow the snorkel to be water resisting even the whole snorkel dives into the water.

SUMMARY OF THE INVENTION

The present invention is an illuminating device located on the top of a snorkel, so that the user can get attention from others.

Illuminating device assembled on the top of a snorkel. When water or other means that activates the switch (manual switches), the device can illuminate and catch other's attention.

The above-mentioned mechanism of producing illuminate, can be designed to provide a aperture on the position of conductive plate or wire, while during usage, the cell can be wet most of the time, yet being electrical conductive. Therefore, the user can be seen from farther away.

The position which positioning the above-mentioned conductive plate or wire, can be a flat surface, which means, the device only illuminate when the user dives into the water or when the wave covers it.

The illuminating device described above has its LED (or bulb or other illuminating source) lightened up by electricity conducted through water.

The illuminating device above includes a sealed housing, where the circuit, battery, and LED's are assembled inside. Also, at least a pair of conductive plate or wire extending to the outside of the close housing, by using the water outside of the housing to conduct the electricity and allow the LED (or other illuminating source) to lighten up.

The housing described above can be made by glowing or transparent materials, so it can be easier to get detected.

The illuminating source or LED described above can have different type of illuminating styles, such as continuous, blinking . . . etc, due to different circuit layout.

The conductive plate or wire described above is made of electric conductive metal. It can be assembled on the top, side, bottom or some location of the splash protector of the housing when it extending out from the housing. By using water, the electricity can be conducted and lighten up the light source.

The housing described above does not limited to the shape described in drawings, the main idea is to put the circuits, light source, or batteries inside. The shapes can be like a ring or others, also.

Said light source can be LED, bulb, or other lighting device, which is located in the housing.

Except by using water to conduct the electricity, the light source can also be lighten up by using switches. The idea is to also allow the light source on the snorkel to get lighten up by operated manually.

DETAILED DESCRIPTION OF THE INVENTION

Figure 1:
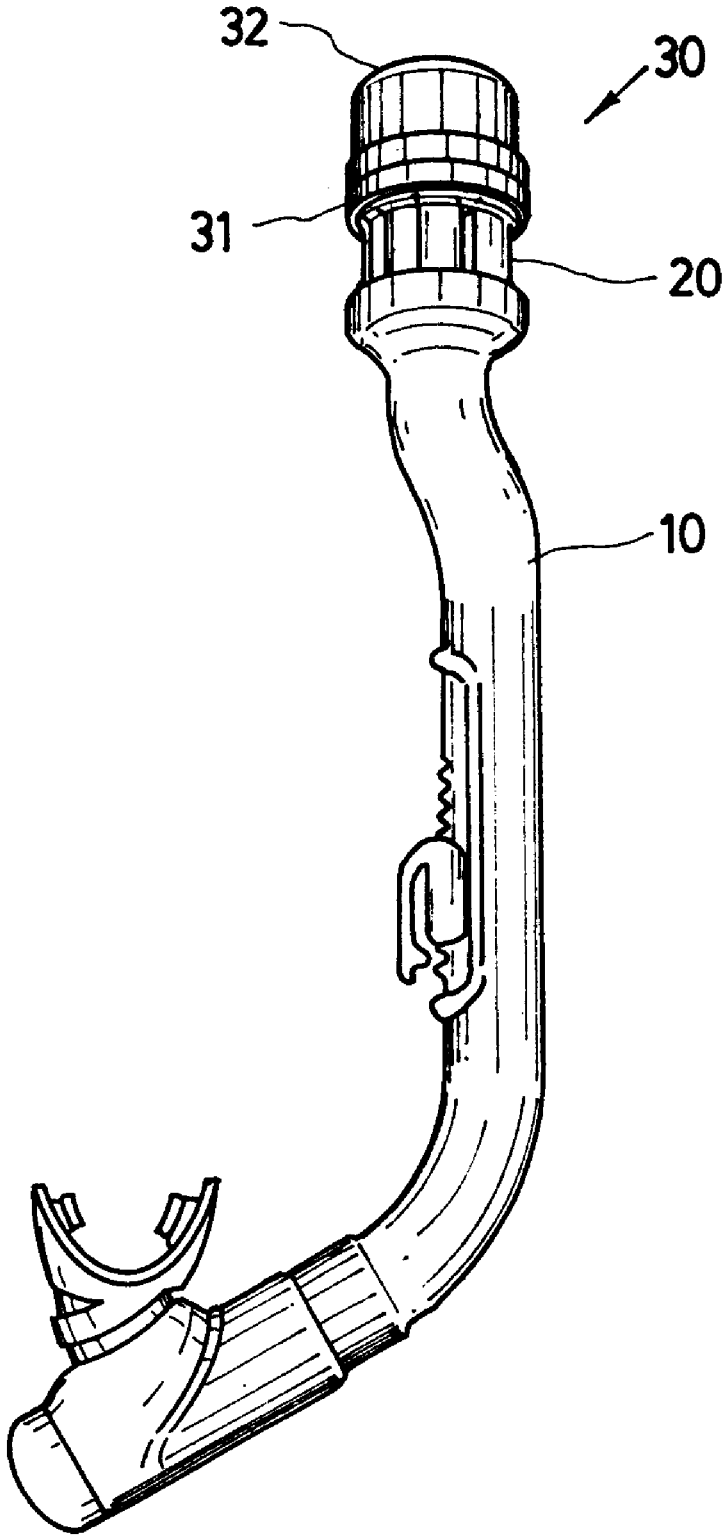
FIG. 1 is a perspective view of the present invention.

According to FIG. 1, the present invention is assembled above the splash protector 20 on the top of snorkel 10. The present case's light source 30 can directly assemble to any kind of snorkel, either on the top or at the circumference.

The splash protector 20 is a known device works with the snorkel to allow air flow through, spit out the water, and prevent from water entering.

Figure 2:
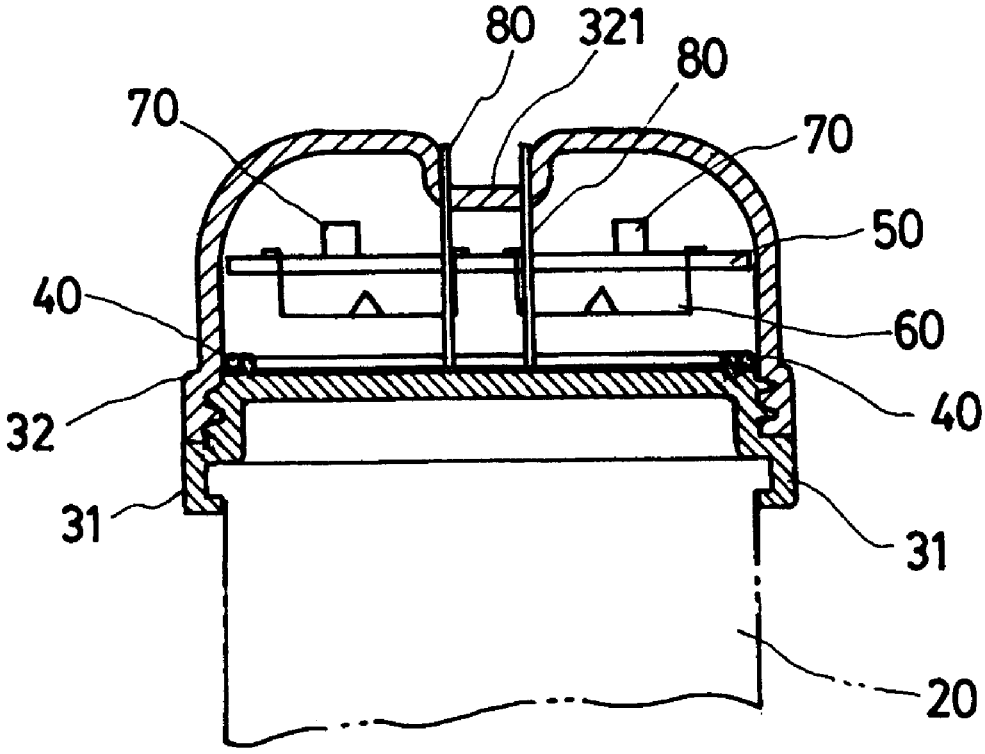
FIG. 2 is a cross sectional view of the present invention.
Figure 3:
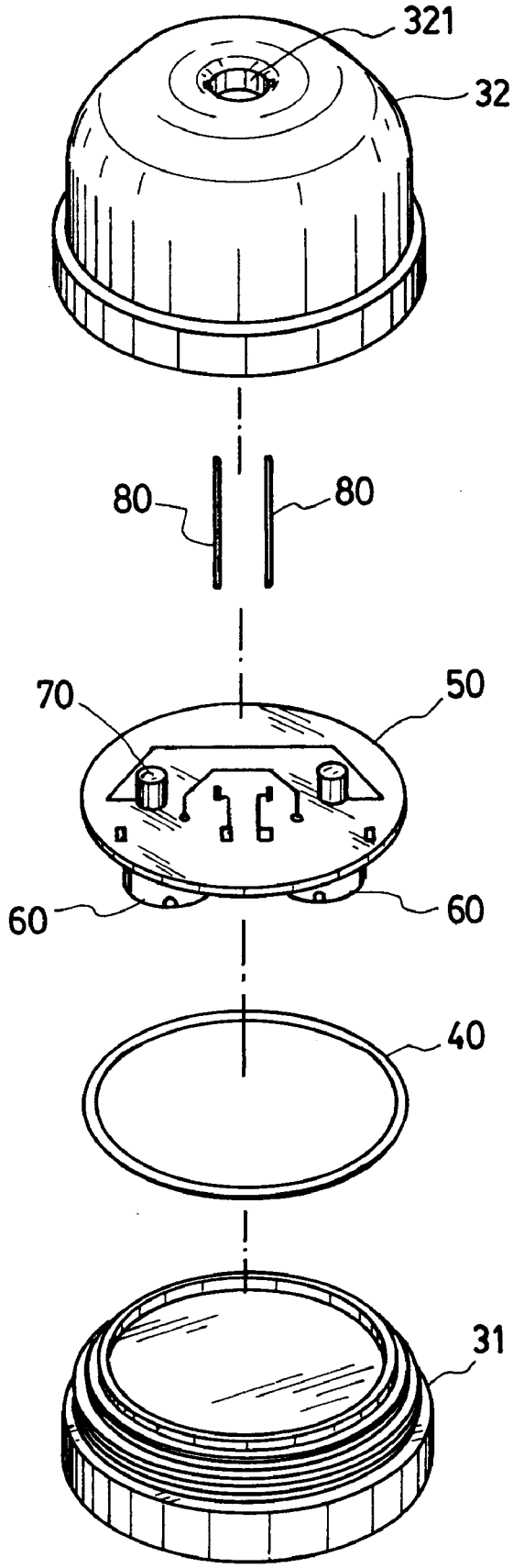
FIG. 3 is an exploded view of the present invention.

According to FIG. 2 and 3, the present invention's cross section view and exploded view, the invention includes a base, 31, a cover 32 (refer to FIG. 1), an O-ring seal 40, and a circuit board 50, batteries 60, LED 70, and a least a pair of conductive plate or wire 80 are assembled on the circuit board 50.

The base 31 described above can be assembled on the splash protector 20. When the base 31 and the cover 32 combines and work with the O-ring seal 40, the inner part of the cover 32 can keep dry.

The batteries' power goes through the circuit board 50 and lightens up the light source (i.e. LED 70 or bulb). The circuit design is a known technology, and on the circuit board 50, there are batteries 60 and LED 70 assembled. Also, there is at least a pair of conductive plate or wire 80 to be the control of ON/OFF. When the conductive plate or wire 80 is conducted, the LED 70 can be lightened up. The conductive plate or wire 80 can include a manual switch, a magnetic switch or a button switch.

According to the figures, the pair of conductive plate or wire 80 described above extends to the top of the cover 32 into the groove 321. By gluing and sealing the conductive plate or wire 80, the water is stopped will not get into the cover 32. When the groove 321 is filled with water, the electricity will go through, then, the LED 70 can be lightened up.

The cover 32 can be made by fluorescent material, this way, the light emitted from the LED 70 and the user can be easier to get attention.

Figure 4:
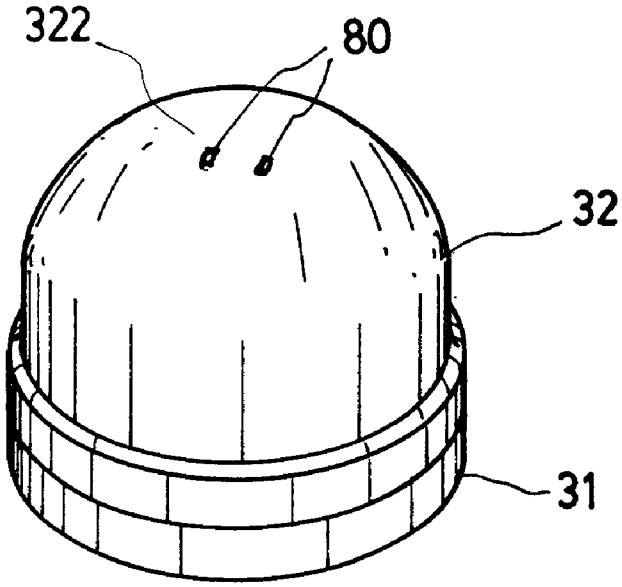
FIG. 4 is another perspective view of the present invention.

According to FIG. 4, the surface of top 322 is flat and smooth, water is not easy to stay on between the conductive plate or wire 80 while it is above the water surface. Yet only in special situations the electricity will go through and lighten up the cover 32.

Figure 5:
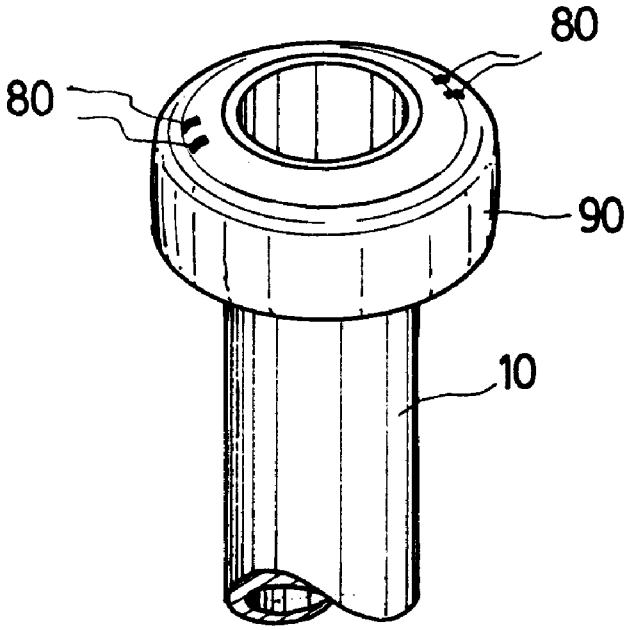
FIG. 5 is another perspective view of the present invention.

FIG. 5 is another perspective view of the present invention; it shows the light source 90 on top of the snorkel 10.

Two pairs of conductive plate or wire 80 are assembled on the light source 90.

Figure 6:
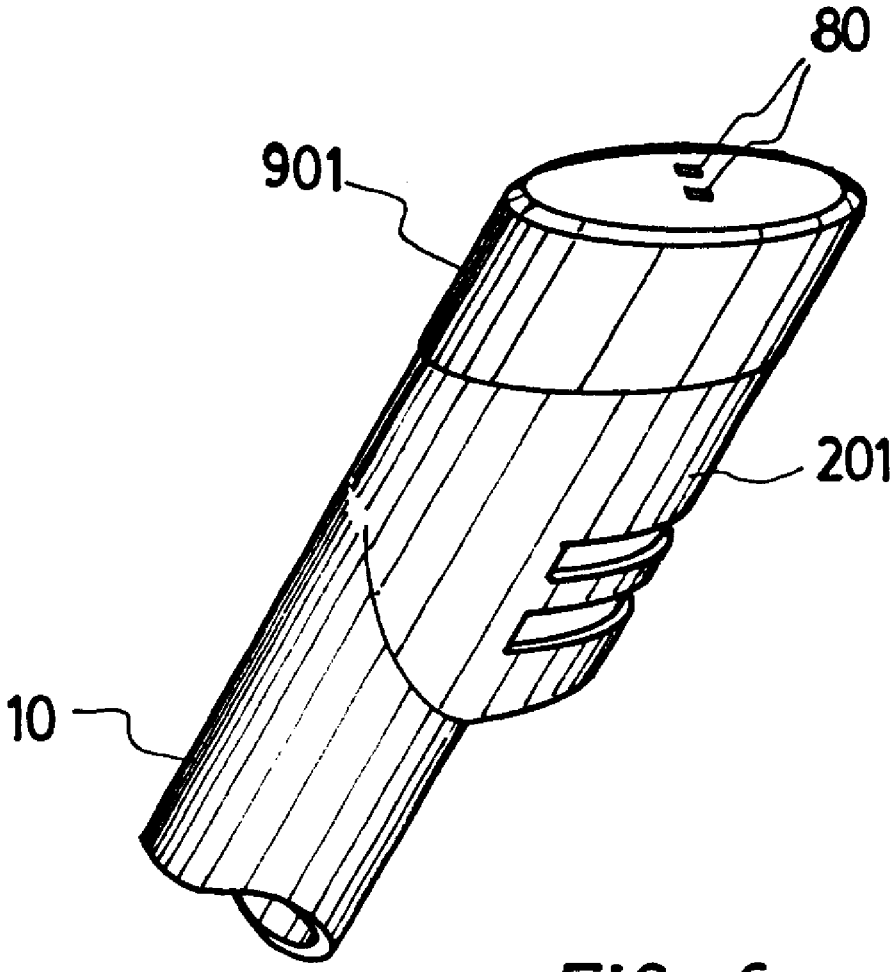
FIG. 6 is another perspective view of the present invention.

FIG. 6 is another perspective view of the present invention; a integrally shape matching light source 901 and a pair of conductive plate or wire 80 are assembled on top of the snorkel 10.

In conclusion, the present invention is to provide an illuminating device on the top of the snorkel. By the light, the user can get attention from others to keep safe.

The illuminating style can be continuous, flashing or other styles, they are not necessary to be further limited.

According to FIGS. 4 to 6, the present invention's illuminating device is not limited to any shape. It can also combine well with the splash protector and the top of the snorkel.

What is claimed is:

1. A luminous device for a snorkel comprising:

a) a housing having:

i) a base connected to the snorkel; and ii) a cover connected and sealed to the base;

b) a light source having an on state and an off state, and located in the housing;

c) a power source electrically connected to the light source; and d) at least one pair of conductive plates extending through and sealed with the cover, and electrically connected to the light source, exterior ends of the at least one pair of conductive plates are located on an exterior of the cover, wherein the light source is in the on state when the exterior ends of the at least one pair of conductive plates are electrically connected by water and in the off state when the exterior ends of the at least one pair of conductive plates are not connected by water.

2. The luminous device according to claim 1, further comprising a circuit board located in the housing and electrically connected to the light source and the power supply.

3. The luminous device according to claim 1, further comprising an O-ring seal located between the base and the cover.

4. The luminous device according to claim 1, wherein the light source is an LED.

5. The luminous device according to claim 1, wherein the light source is a bulb.

6. The luminous device according to claim 1, wherein the power supply is a battery.

7. The luminous device according to claim 1, wherein the cover is made of a flourescent material.

8. The luminous device according to claim 1, wherein the top of the cover includes a groove, and the exterior ends of the at least one pair of conductive plates are located in the groove.

9. The luminous device according to claim 1, wherein the top of the cover is flat and smooth.

10. The luminous device according to claim 1, wherein the housing is integrally made with the snorkel.

* * * * *